US007220911B2

(12) United States Patent
Basu

(10) Patent No.: US 7,220,911 B2
(45) Date of Patent: May 22, 2007

(54) ALIGNING AND MIXING SONGS OF ARBITRARY GENRES

(75) Inventor: Sumit Basu, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 11/381,449

(22) Filed: May 3, 2006

(65) Prior Publication Data

US 2006/0192478 A1 Aug. 31, 2006

Related U.S. Application Data

(63) Continuation of application No. 10/883,124, filed on Jun. 30, 2004, now Pat. No. 7,081,582.

(51) Int. Cl.
*G10H 7/00* (2006.01)
*G10H 1/08* (2006.01)

(52) U.S. Cl. ..... 84/625; 700/94

(58) Field of Classification Search ..... 84/625, 84/660; 700/94

See application file for complete search history.

(56) References Cited

U.S. PATENT DOCUMENTS 6,307,141 B1 * 10/2001 Laroche et al. ..... 84/636
6,344,607 B2 * 2/2002 Cliff ..... 84/611
6,518,492 B2 * 2/2003 Herberger et al. ..... 84/636
6,831,883 B1 * 12/2004 Yamada et al. ..... 369/47.16
2002/0002898 A1 * 1/2002 Schmitz et al. ..... 84/645
2002/0166440 A1 * 11/2002 Herberger et al. ..... 84/625

* cited by examiner

*Primary Examiner*—Jeffrey W Donels
(74) *Attorney, Agent, or Firm*—Lyon & Harr, LLP; Mark A. Watson

(57) ABSTRACT

A "music mixer", as described herein, provides a capability for automatically mixing arbitrary pieces of music, regardless of whether the music being mixed is of the same music genre, and regardless of whether that music has strong beat structures. In automatically determining potential mixes of two or more songs, the music mixer first computes a frame-based energy for each song. Using the computed frame-based energies, the music mixer then computes one or more potentially optimal alignments of the digital signals representing each song based on correlating peaks of the computed energies across a range of time scalings and time shifts without the need to ever compute or evaluate a beats-per-minute (BPM) for any of the songs. Then, once one of the potentially optimal time-scalings and time-shifts has been selected, the songs are then simply blended together using those parameters.

20 Claims, 6 Drawing Sheets

ALIGNING AND MIXING SONGS OF ARBITRARY GENRES

CROSS REFERENCE TO RELATED APPLICATIONS

This application is a Continuation Application of U.S. patent application Ser. No. 10/883,124, filed on Jun. 30, 2004 now U.S. Pat. No. 7,081,582, by Sumit Basu, and entitled "A SYSTEM AND METHOD FOR ALIGNING AND MIXING SONGS OF ARBITRARY GENRES," and claims priority to U.S. patent application Ser. No. 10/883,124 under Title 35, United States Code, Section 120.

BACKGROUND

1. Technical Field

The invention is related to blending or mixing of two or more songs, and in particular, to a system and process for automatically blending different pieces of music of arbitrary genres, such as, for example, automatically blending a heavily beat oriented song (i.e., a "Techno" type song) with a melodic song, such as a piano tune by Mozart, using automatic time-scaling, resampling and time-shifting without the need to determine beats-per-minute (BPM) of the blended songs.

2. Related Art

Conventional music mixing typically involves the blending of part or all of two or more songs. For example, mixing may involve blending the end of Song A into the beginning of Song B for smoothly transitioning between the two songs. Further, such mixing may also involve actually combining Song A and Song B for simultaneous playback to create a mixed song comprised of both Song A and Song B.

Clearly, simply playing two songs at the same time without any intervention would typically result in a discordant mix of unaligned music. Therefore, successful music mixing typically involves a number of factors that must be considered on a song-by-song basis. For example, these factors often include determining which song to transition into from a current song; when to do the transition in Song A; where in Song B to cut into; any timescale adjustment necessary to align Song A to Song B; and any time offsets required to align Song A and Song B.

There are a number of conventional schemes which are used for automatically mixing or blending two or more songs. Such schemes are frequently used by "DJ's" for mixing two or more songs to provide mixed dance music in real time, and to transition from one song to another as smoothly as possible. These conventional schemes include a variety of software and hardware tools, and combinations of both software and hardware.

In general, these conventional schemes typically operate by first estimating a "beats-per-minute" (BPM) count of music with heavy beats. Simultaneously estimating the BPM of two songs allows one or both of the songs to be time shifted or otherwise scaled to match the BPM of the songs so that they may be smoothly combined and played simultaneously, thereby creating a new mixed song that is a combination of both songs. Similarly, such conventional schemes allow the selection of an appropriate speed change and/or time shift to be applied to one or both songs so as to smoothly transition between two different pieces of music.

Most conventional mixing schemes focus simply on estimating the (BPM) of each song. In the simplest approach, a DJ simply changes the speed of the first and/or second song until the BPM's match, and then manually finds an offset in the songs to match up or align the beats. More sophisticated schemes use the computed BPM for each song to automatically determine an offset for alignment by automatically finding the locations of the beat sounds.

Unfortunately, such schemes tend to perform poorly where the BPM of one or more of the songs is not clearly discernable, or where the BPM varies or shifts over time. In such cases, conventional mixing schemes often fail to provide an alignment or mixing which maintains a reasonable quality across such changing BPM's. Any misalignment of the songs is then typically readily apparent to human listeners.

Some work has been done in estimating a beat structure of a single piece of music, rather than simply computing a BPM for that piece of music. Such schemes can also be used for aligning two or more pieces of music. For example, one such scheme estimates a beat structure via correlations across a number of filter banks. Another scheme provides a probabilistic approach that allows for variation in the beat of a song. Each of these methods are capable of estimating the beat structure of a song, however, if they were to be used to align two pieces of music, each would be susceptible to problems similar to the schemes which operate on simple BPM computations because they consider each song separately, and then estimate or compute time scaling and alignment in the same manner as the BPM schemes described above.

One problem common to all of the above-mentioned mixing schemes is an inability to successfully mix songs of significantly different genres. For example, the above-mentioned schemes are typically capable of mixing techno/dance songs (i.e., songs with significant beats and strong beat structure). However, these schemes will typically produce unacceptable results when attempting to mix songs of widely varying genres, such as, for example a Techno-type song having strong beats or beat-like sounds, with a piece of classical piano music that does not have strong beats.

Therefore, what is needed is a system and method for automatically aligning two or more songs for blending or mixing either all or part of those songs for at least partially simultaneous or overlapping playback (i.e., song transitioning or full mixing). However, because not all songs have strong beats, such a system and method should be able to mix in cases where one song has strong beats and the other does not without the need to actually determine the BPM of either song. Further, such a system and method should be computationally efficient so as to operate in at least real-time or faster.

SUMMARY

A "music mixer", as described herein, operates to solve the problems existing with conventional music mixing schemes by extending the range of music which can be successfully mixed, regardless of whether the various pieces of music being mixed are of the same music genre, and regardless of whether that music has strong beat structures. For example, the music mixer is fully capable of nicely blending such diverse music as a piano concerto by Mozart with modern Techno-style dance music. Further, unlike conventional mixing schemes, the music mixer operates without the need to compute a beats-per-minute (BPM) for any of the songs being mixed or blended by determining optimal alignments of computed energy peaks across a range of time-scalings and time-shifts. Finally, in one embodiment, the music mixer approximates the energy of time-scaled signals so as to significantly reduce computational overhead, and to allow real-time mixing of songs or music.

Conventional schemes typically compute a beats-per-minute (BPM) for two songs, and then align those songs on the beat by time-scaling and time-shifting the songs to align the beats. However, unlike such schemes, the music mixer described herein first computes a frame-based energy for each song. Using the computed frame-based energies, the music mixer then computes many possible alignments and then selects one or more potentially optimal alignments of the digital signals representing each song. This is done by correlating peaks of the computed energies across a range of time scalings and time shifts without the need to ever compute a BPM for any of the songs.

Once one of the potentially optimal time-scalings and time-shifts has been selected, the songs are then simply blended together using those parameters. Note that in one embodiment, the blending at this point is a simple one-to-one combination of the time-scaled and time-shifted signals to create a composite signal.

In a related embodiment, the average energy of one or more of the signals is also scaled prior to combining the signals. Scaling the energy of the signals allows for better control over the relative contribution of each signal to the overall composite signal. For example, where it is desired to have a composite signal where each song provides an equal contribution to that composite signal, the average energy of one or more of the songs is scaled so that the average energy of each song is equal. Similarly, where it is desired that a particular song dominate over any other song in the composite, it is a simple matter to either increase the average energy of that song, or conversely, to decrease the average energy of any other song used in creating the composite.

More specifically, the music mixer described herein provides a system and method for mixing music or songs or arbitrary genre by examining computed energies of two or more songs to identify one or more possible temporal alignments of those songs. It should be noted that the music mixer described herein is fully capable of mixing or blending at least two or more songs. However, for purposes of clarity of explanation, the music mixer will be described in the context of mixing only two songs, which will be generally referred to herein as "Song A" and "Song B." Further, it should be noted that Song A and Song B are not necessarily complete songs or pieces of music, and that reference to songs throughout this document is not intended to suggest or imply that songs must be complete to be mixed or otherwise combined.

In one embodiment, the music mixer sets one of the songs (Song A) as a "master" which will not be scaled or shifted, and the other song (Song B) as a "slave" which is then time-scaled and time-shifted to achieve alignment to the master for creating the composite. However, in a related embodiment, the music mixer allows for user switching of the master and slave tracks. Switching the master and slave tracks for any particular mix, with only the slave track typically being scaled and shifted, will typically result in a significantly perceptually different mix than the unswitched version of the mix.

As noted above, in determining possible mixes, a frame-based energy is first computed for each song. Given the computed frame-based energies for Song A and Song B, the computed energy signal for Song B is then scaled over some predetermined range, such as, for example, 0.5 to 2.0 (i.e., half-speed to double-speed) at some predetermined step size. For example, given a scaling range of 0.5 to 2.0, and a step size of 0.01, there will be 150 scaling steps for the energy signal of Song B. Then, at each scaling step, the scaled energy signal of Song B is shifted in one sample increments across some predetermined sample range and compared to the energy signal of Song A to identify correlation peaks which will represent potentially optimal alignment points between Song A and Song B.

For example, assuming that a selection of the computed energy signals of 1000 samples in length will be used to identify correlation peaks between the energy signals of Song A and Song B with a correlation range of 100 samples, and assuming the example of 150 scaling steps described above, then the energy signal of Song A will be compared to 15,000 scaled/shifted versions of the energy signal of Song B to identify one or more correlation peaks. Note that in this context, samples refer to energy samples, each of which corresponds to 512 audio samples in a typical embodiment; thus 1000 energy samples correspond to 512,000 audio samples or about 12 seconds. It should be clear that computing such large numbers of energy signals for each scaled version of Song B for determining correlations between the signals is computationally expensive. Therefore, in one embodiment, an approximation of the computed energy signals is introduced to greatly speed up the evaluation of the possibly tens of thousands of possible matches represented by peaks in the correlation evaluation of the energy signals of Song A and Song B.

In general, the more pronounced the correlation peak, the better the resulting alignment of Song A and Song B, in terms of a mix quality as perceived by a human listener. Therefore, in one embodiment, the strongest peak is automatically selected as corresponding to the time-shifting and time-scaling parameters that will then be applied to Song B. Song B is then temporally shifted and scaled in accordance with those parameters, and then it is simply combined with Song A as noted above.

The processes described above for identifying correlation peaks will often return two or more strong peaks. Consequently, in another embodiment, a user is provided with a selection of some number of the strongest peaks, and allowed to select from those peaks in temporally scaling and shifting Song B for combining or mixing it with Song A. In a tested embodiment, selection of particular peaks is accompanied by an audible preview version of the mixed songs that would result from selection of the parameters represented by each peak so that the user can actually hear a sample of what a particular mix will sound like before selecting that mix for playback.

Further, in a related embodiment, the music mixer automatically computes a suitability score or metric, which describes how good any particular match or alignment will be. For example, it has been observed that in the case where there are a large number of scattered correlation peaks of around the same value, then none of the possible alignments of Song A and Song B tends to sound particularly good when heard by a human listener. Conversely, where there are only a few very pronounced and isolated peaks, each of those peaks tends to correspond to possible alignments of Song A and Song B that do sound particularly good when heard by a human listener.

Therefore, in one embodiment, both the shape, value, and local environment of each peak (relative to the surrounding correlation peaks and values) are examined in computing a suitability metric for attempting to identify those correlation peaks which correspond to alignments that will sound good to a human listener. Using this suitability metric, in some cases a particular correlation peak having a lower magnitude than other peaks might still exhibit a higher suitability, depending upon its shape, and its relationship to any surrounding peaks. Possible alignments are then presented to the user in order of suitability score, from highest to lowest.

In view of the above summary, it is clear that the music mixer described herein provides a unique system and method for automatically mixing two or more songs of arbitrary genre and beat structure without the need to determine a BPM of any of the songs. In addition to the just described benefits, other advantages of the music mixer will become apparent from the detailed description which follows hereinafter when taken in conjunction with the accompanying drawing figures.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings, which form a part hereof, and in which is shown by way of illustration specific embodiments in which the invention may be practiced. It is understood that other embodiments may be utilized and structural changes may be made without departing from the scope of the present invention.

Figure 1:
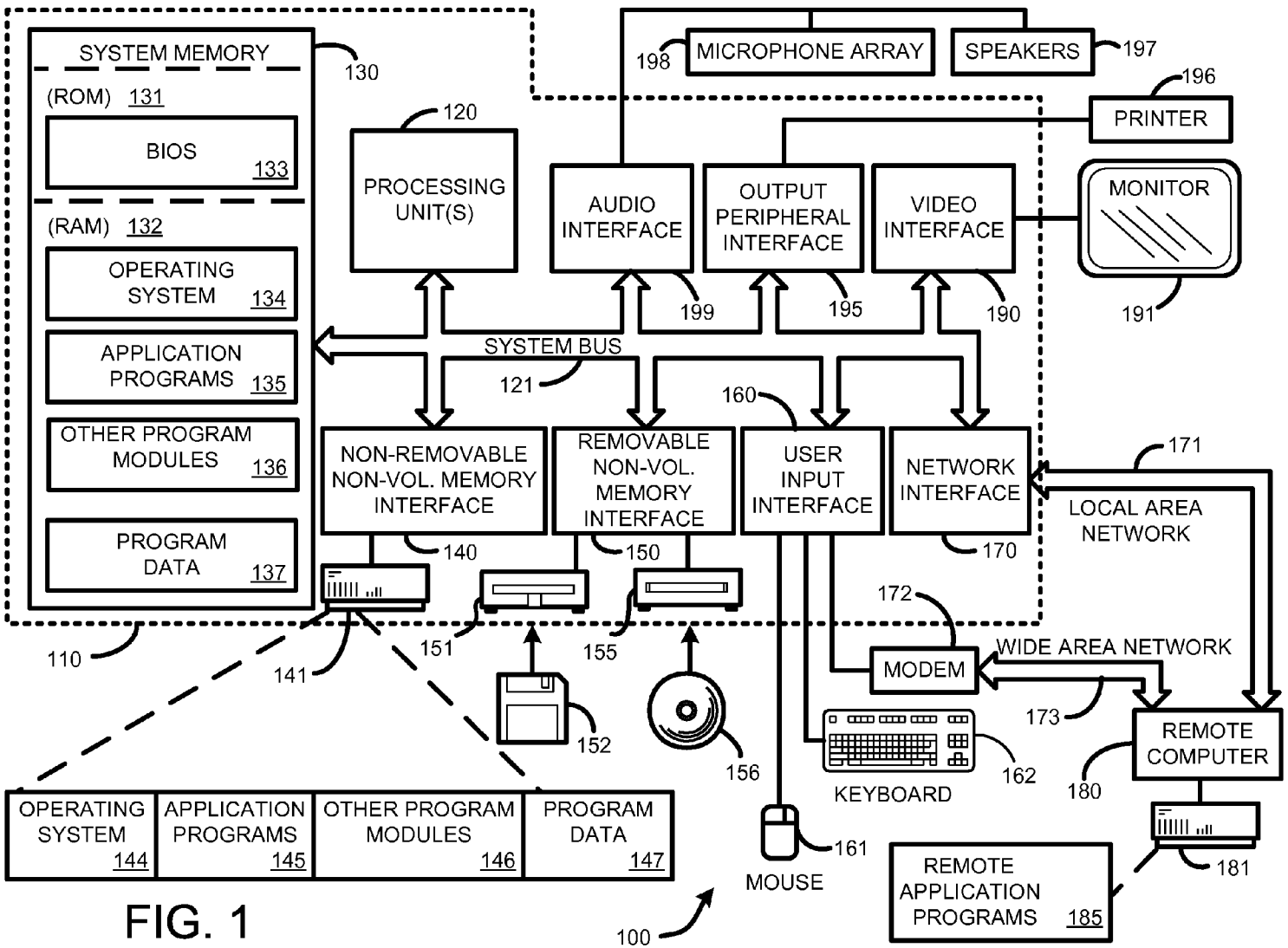
FIG. 1 is a general system diagram depicting a general-purpose computing device constituting an exemplary system implementing a music mixer, as described herein.

1.0 Exemplary Operating Environment:

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held, laptop or mobile computer or communications devices such as cell phones and PDA's, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer in combination with hardware modules, including components of a microphone array 198. Generally, program modules include routines, programs, objects, components, data structures, etc., that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices. With reference to FIG. 1, an exemplary system for implementing the invention includes a general-purpose computing device in the form of a computer 110.

Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes volatile and nonvolatile removable and non-removable media implemented in any method or technology for storage of information such as computer readable instructions, data structures, program modules, or other data.

Computer storage media includes, but is not limited to, RAM, ROM, PROM, EPROM, EEPROM, flash memory, or other memory technology; CD-ROM, digital versatile disks (DVD), or other optical disk storage; magnetic cassettes, magnetic tape, magnetic disk storage, or other magnetic storage devices; or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 110 through input devices such as a keyboard 162 and pointing device 161, commonly referred to as a mouse, trackball, or touch pad.

Other input devices (not shown) may include a joystick, game pad, satellite dish, scanner, radio receiver, and a television or broadcast video receiver, or the like. These and other input devices are often connected to the processing unit 120 through a wired or wireless user input interface 160 that is coupled to the system bus 121, but may be connected by other conventional interface and bus structures, such as, for example, a parallel port, a game port, a universal serial bus (USB), an IEEE 1394 interface, a Bluetooth™ wireless interface, an IEEE 802.11 wireless interface, etc. Further, the computer 110 may also include a speech or audio input device, such as a microphone or a microphone array 198, as well as a loudspeaker 197 or other sound output device connected via an audio interface 199, again including conventional wired or wireless interfaces, such as, for example, parallel, serial, USB, IEEE 1394, Bluetooth™, etc.

A monitor 191 or other type of display device is also connected to the system bus 121 via an interface, such as a video interface 190. In addition to the monitor, computers may also include other peripheral output devices such as a printer 196, which may be connected through an output peripheral interface 195.

The computer 110 may operate in a networked environment using logical connections to one or more remote computers, such as a remote computer 180. The remote computer 180 may be a personal computer, a server, a router, a network PC, a peer device, or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets, and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

The exemplary operating environment having now been discussed, the remaining part of this description will be devoted to a discussion of the program modules and processes embodying a "music mixer" which automatically determines one or more potential mixes for two or more pieces of music of arbitrary genre.

2.0 Introduction:

A "music mixer", as described herein, provides the capability of mixing arbitrary pieces of music, regardless of whether the various pieces of music being mixed are of the same music genre, and regardless of whether that music has strong beat structures. In automatically determining potential mixes of two or more songs, the music mixer first computes a frame-based energy for each song. Using the computed frame-based energies, the music mixer then computes one or more potentially optimal alignments of the digital signals representing each song based on correlating peaks of the computed energies across a range of time scalings and time shifts without the need to ever compute or evaluate a beats-per-minute (BPM) for any of the songs. Then, once one of the potentially optimal time-scalings and time-shifts has been selected, the songs are then simply blended together using those parameters.

2.1 System Overview:

As noted above, the music mixer described herein provides a system and method for mixing music or songs or arbitrary genre by examining computed energies of two or more songs to identify one or more possible temporal alignments of those songs. It should be noted that the music mixer described herein is fully capable of mixing or blending at least two or more songs. However, for purposes of clarity of explanation, the music mixer will be generally described in the context of mixing only two songs, which will be generally referred to herein as "Song A" and "Song B." Further, it should be noted that Song A and Song B are not necessarily complete songs or pieces of music, and that any references to "Song A," "Song B," or simply to songs in general throughout this document, are not intended to suggest or imply that such songs must be complete to be mixed or otherwise combined. Clearly, portions of particular songs or pieces of music less than complete songs may be mixed or otherwise combined.

In one embodiment, the music mixer sets one of the songs (Song A) as a "master" which will not be scaled or shifted, and the other song (Song B) as a "slave" which is then time-scaled and time-shifted to achieve alignment to the master for creating the composite. However, in a related embodiment, the music mixer allows for user switching of the master and slave tracks. Switching the master and slave tracks for any particular mix, with only the slave track typically being scaled and shifted, will typically result in a significantly perceptually different mix than the unswitched version of the mix.

As noted above, in determining possible mixes, a frame-based energy is first computed for each song. Given the computed frame-based energies for Song A and Song B, the computed energy signal for Song B is then scaled over some predetermined range, such as, for example, 0.5 to 2.0 (i.e., half-speed to double-speed) at some predetermined step size. For example, given a scaling range of 0.5 to 2.0, and a step size of 0.01, there will be 150 scaling steps for the energy signal of Song B. Then, at each scaling step, the scaled energy signal of Song B is shifted in one sample increments across some predetermined sample range and compared to the energy signal of Song A to identify correlation peaks which will represent potentially optimal alignment points between Song A and Song B.

For example, assuming that a selection of the computed energy signals of 1000 samples in length will be used to identify correlation peaks between the energy signals of Song A and Song B with a correlation range of 100 samples, and assuming the example of 150 scaling steps described above, then the energy signal of Song A will be compared to 15,000 scaled/shifted versions of the energy signal of Song B to identify one or more correlation peaks. Note that in this context, samples refer to energy samples, each of which corresponds to 512 audio samples in a typical embodiment; thus 1000 energy samples correspond to 512,000 audio samples or about 12 seconds. It should be clear that computing such large numbers of energy signals for each scaled version of Song B for determining correlations between the signals is computationally expensive. Therefore, in one embodiment, an approximation of the computed energy signals is introduced to greatly speed up the evaluation of the possibly tens of thousands of possible matches represented by peaks in the correlation evaluation of the energy signals of Song A and Song B.

In general, the more pronounced the correlation peak, the better the resulting alignment of Song A and Song B, in terms of a mix quality as perceived by a human listener. Therefore, in one embodiment, the strongest peak is automatically selected as corresponding to the time-shifting and time-scaling parameters that will then be applied to Song B.

The processes described above for identifying correlation peaks will often return two or more strong peaks. Therefore, in another embodiment, a user is provided with a selection of some number of the strongest peaks, and allowed to select from those peaks in temporally scaling and shifting Song B for combining or mixing it with Song A. In a tested embodiment, selection of particular peaks is accompanied by an audible preview version of the mixed songs that would result from selection of the parameters represented by each peak so that the user can actually hear a sample of what a particular mix will sound like before selecting that mix for playback.

Further, in a related embodiment, the music mixer automatically computes a suitability score or metric, which describes how good any particular match or alignment will be. For example, it has been observed that in the case where there are a large number of scattered correlation peaks of around the same value, then none of the possible alignments of Song A and Song B tends to sound particularly good when heard by a human listener. Conversely, where there are only a few very pronounced and isolated peaks, each of those peaks tends to correspond to possible alignments of Song A and Song B that do sound particularly good when heard by a human listener.

Therefore, in one embodiment, both the shape, value, and local environment of each peak (relative to the surrounding correlation peaks and values) are examined in computing a suitability metric for attempting to identify those correlation peaks which correspond to alignments that will sound good to a human listener. Using this suitability metric, in some cases, a particular correlation peak having a lower magnitude than other peaks might still exhibit a higher suitability, depending upon its shape, and its relationship to any surrounding peaks. Possible alignments are then presented to the user in order of suitability score, from highest to lowest.

Finally, given a selected alignment (corresponding to a particular shift and and scaled in accordance with those parameters, and then it is simply combined with Song A using conventional techniques for combining audio signals to create a composite signal, e.g., in this embodiment, summing the two signals together. However, in a related embodiment, an average energy of one or more of the songs is also scaled prior to combining the signals. Scaling the energy of the songs scaling) Song B is then temporally shifted allows for better control over the relative contribution of each song to the overall composite or mixed song. For example, where it is desired to have a composite signal where each song provides an equal contribution to that composite signal, the average energy of one or more of the songs is scaled so that the average energy of each song is equal. Similarly, where it is desired that a particular song dominate over any other song in the composite, it is a simple matter to either increase the average energy of that song, or conversely, to decrease the average energy of any other song used in creating the composite.

Figure 2:
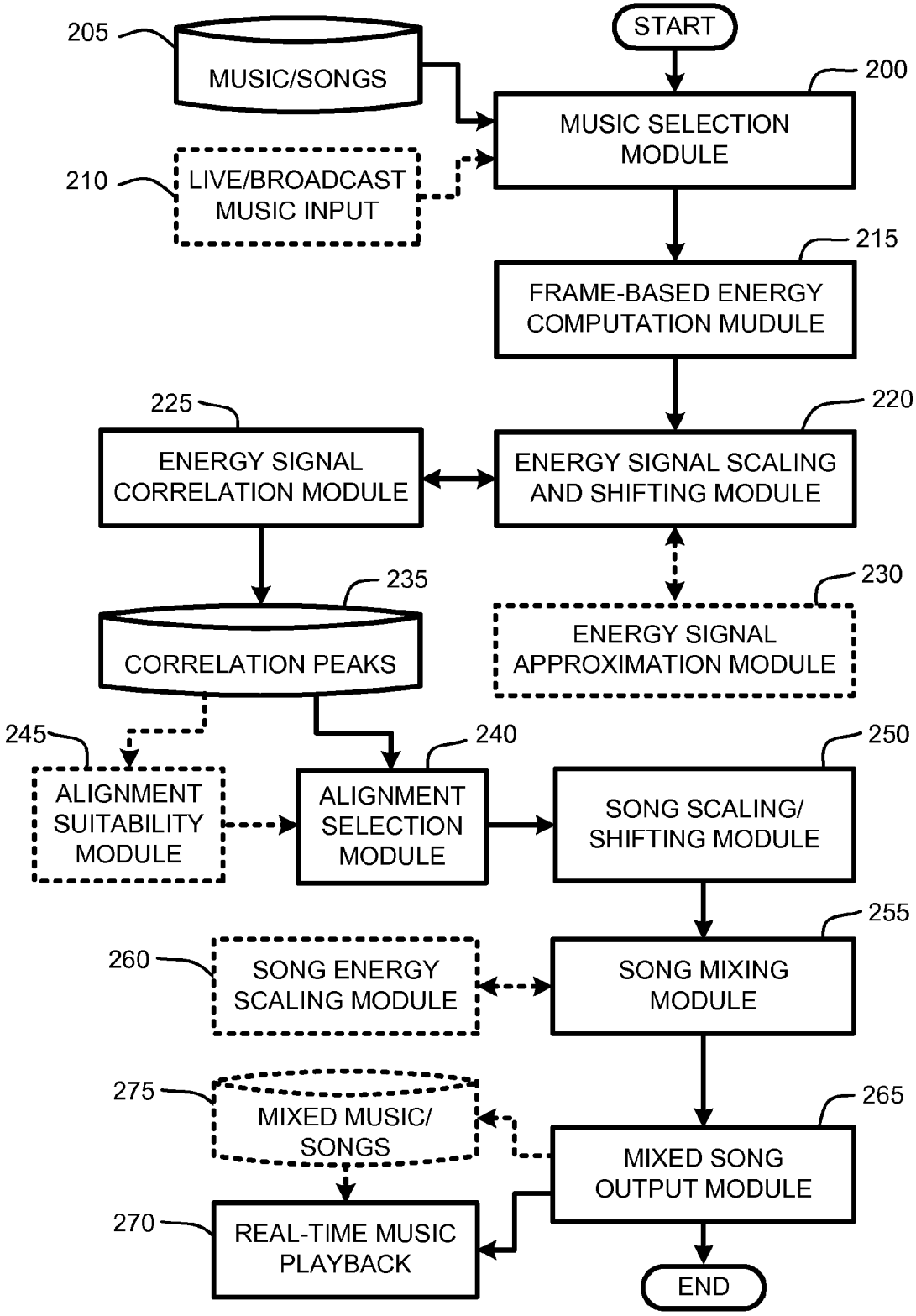
FIG. 2 illustrates an exemplary system diagram showing exemplary program modules for implementing a music mixer, as described herein.

2.2 System Architectural Overview:

The processes summarized above are illustrated by the general system diagram of FIG. 2. In particular, the system diagram of FIG. 2 illustrates the interrelationships between program modules for implementing a music mixer, as described herein. It should be noted that any boxes and interconnections between boxes that are represented by broken or dashed lines in FIG. 2 represent alternate embodiments of the music mixer described herein, and that any or all of these alternate embodiments, as described below, may be used in combination with other alternate embodiments that are described throughout this document.

In general, the music mixer begins by using a music selection module 200 to select the music songs that will be mixed. These songs can be selected from a variety of sources, including songs stored in a file or database 205, or songs from live or broadcast music inputs 210. In addition to selecting the songs from one of the aforementioned sources, the music selection module 220 also allows one of the selected songs to be designated as a "master" track. The other song, i.e., the "slave" track, will then be scaled and shifted to be mixed into the master track as described in further detail below.

Once the songs to be mixed have been selected, and a master designated, a frame-based energy computation module 215 is then used to compute a frame-based energy signal from each song. As described in further detail below in Section 3.2.1, these energy signals are computed from the selected songs using a conventional energy computation.

Next, as described below in Section 3.2.2, an energy signal scaling and shifting module 220 is used to compute a scaled energy signal for each step size over a predetermined or user specified range of scales, such as for example, a scale range from 0.5 to 2.0, using a scale step size of 0.1 which will produce 150 scales ranging from 0.5 to 2.0. As noted above, any desired range of scales may be applied here, using any desired step size. As described below, brute force methods can be used to recompute the energy signal for the slave for every scale within the predetermined range. However, such brute force methods tend to be rather computationally expensive. Consequently, in one embodiment, an energy signal approximation module 230 is used to quickly approximate the energy signal that would be computed from any scaled version of the slave track. This energy signal approximation is described in further detail in Section 3.2.2.

Then, for each scale step, an energy signal correlation module 225 correlates the corresponding computed or approximated energy signal for the slave track against the energy signal of the master track using a correlation window size based on a predetermined number of samples, with each sample representing an alignment shift. The results of this correlation process are then used by the energy signal correlation module to compute a "match curve" (i.e., a set of correlation scores, C[s]) across each possible alignment shift over the entirety of the correlation window for each time-scale step. In general, each value in the set of correlation scores comprising the match curve represents the alignment shift which has the highest correlation at the corresponding scaling of the energy signal of the slave track. In other words, this match curve represents a set of correlation peaks 235 across the range of alignment offsets and scaling factors. This process is described in further detail below in Section 3.2.2.

An alignment selection module 240 is then used to select at least one correlation peak 235 from the match curve as corresponding to a potentially optimal alignment and scaling combination for mixing Song A and Song B. In a related embodiment, an alignment suitability module 245 is used to evaluate the suitability of the alignment and scaling parameters represented by one or more of the correlation peaks 235.

In particular, as described in further detail below in Section 3.2.4, simply selecting the largest peaks may not result in the most aesthetically pleasing mixes when presented to a human listener. Consequently, in order to evaluate the suitability of particular correlation peaks 235, the alignment suitability module 240 examines the local context of the correlation peaks, relative to the surrounding peaks in the match curve. This evaluation then returns a measure of whether the alignment and scaling represented particular peaks are likely to result in a good mix, relative to a human listener.

In either case, whether or not the suitability of particular correlation peaks has been evaluated, the scaling and alignment values corresponding to the selected correlation peak is used by a song scaling and shifting module 250 to scale and shift Song B. As discussed in further detail below, the scaling of Song B using the parameters of the selected correlation peak is accomplished in alternate embodiments using either a conventional linear scaling, or a conventional pitch-preserving scaling, such as, for example, the well known SOLA technique or the like. Once the song scaling and shifting module 250 has scaled Song B, it is shifted by the song scaling and shifting module in accordance with the alignment value corresponding to the selected correlation peak.

Next, a song mixing module 255 then uses conventional techniques for combining the scaled and shifted version of Song B and the original version of Song A to create a composite or mixed version of the two songs. In related embodiments, a song energy scaling module 260 adjusts or scales the relative energy of one or both of the songs by either scaling the average energy of one song to be equivalent to the other song, or by increasing or decreasing the average energy of one or both songs so as to control the relative contribution of each song to the final mix. Finally, a song output module 265 provides the mixed song for real-time playback 270. Alternately, the mixed song is simply stored 275 for later use, as desired.

3.0 Operation Overview:

The above-described program modules are employed for implementing the music mixer. As summarized above, this music mixer provides automatic mixing of two or more songs of arbitrary genre without the need to examine the beat structure of those songs. The following sections provide a detailed discussion of the operation of the music mixer, and of exemplary methods for implementing the program modules described in Section 2 in view of the operational flow diagram of FIG. 3.

Figure 3:
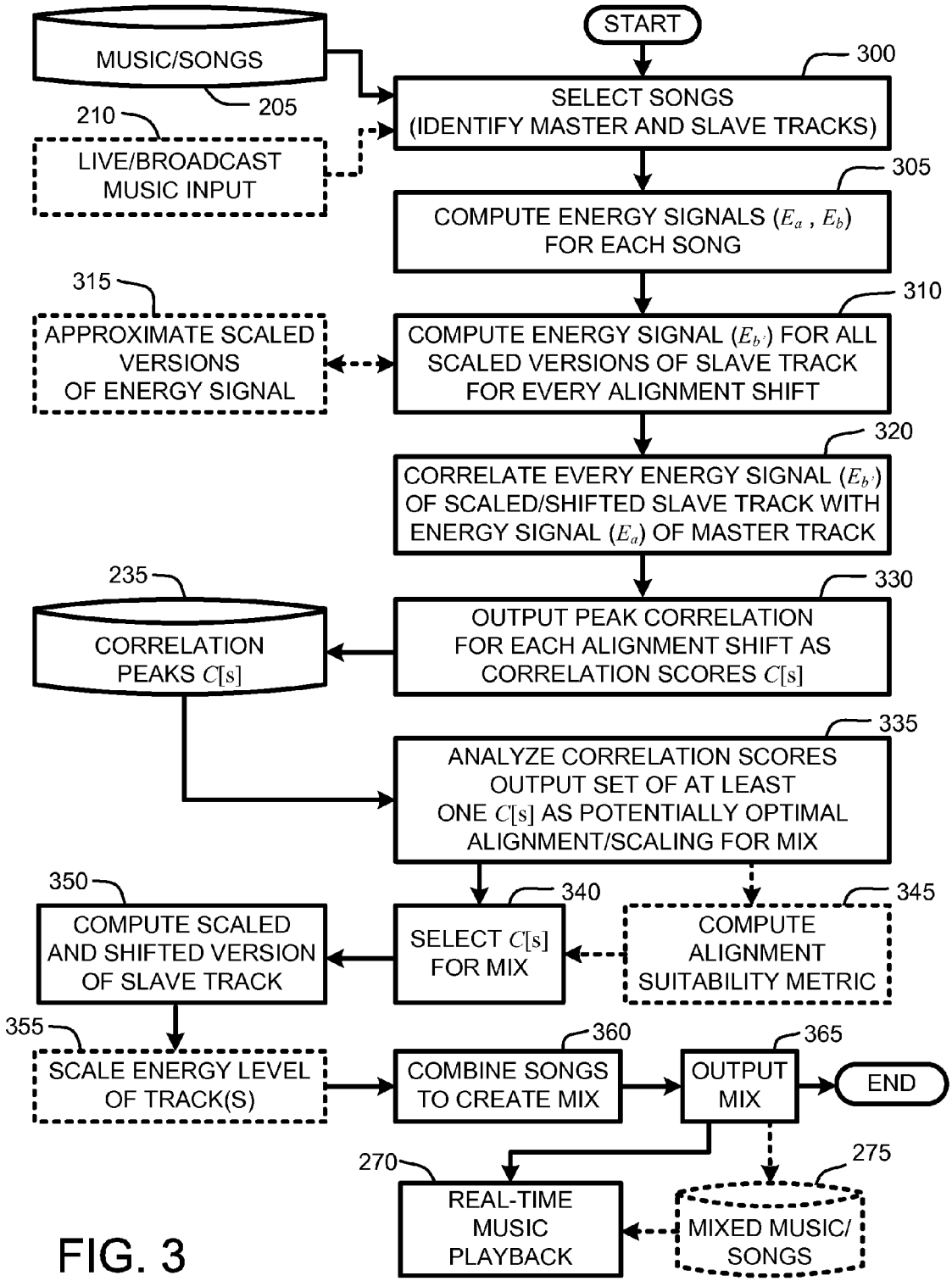
FIG. 3 provides an exemplary flow diagram which illustrates operational flow of a music mixer, as described herein.

It should be noted that any boxes and interconnections between boxes that are represented by broken or dashed lines in FIG. 3 represent alternate embodiments of the music mixer described herein, and that any or all of these alternate embodiments, as described below, may be used in combination with other alternate embodiments that are described throughout this document.

Further, as noted above, while an alignment of energy peaks can easily be computed for more than two songs, for purposes of explanation, the description provided below will focus on determining correlation peaks for the energy signals of two songs. However, it should be understood that the music mixer is not intended to be limited to mixing only two songs.

3.1 Music Mixer Operation:

The processes described above with respect to FIG. 2 are illustrated by the general operational flow diagram of FIG. 3. In particular, FIG. 3 illustrates an exemplary operational flow diagram showing one embodiment of the music mixer.

In particular, as illustrated by FIG. 3, the music mixer described herein begins operation by first selecting two songs, and identifying one as a master track, and the other as a slave track 300. Selection of the songs, and identification of one song as master, and one as slave is accomplished either automatically, or manually via a user interface. As noted above, these songs can be selected from a variety of sources, including songs stored in a file or database 205, or songs from live or broadcast music inputs 210.

Once the songs to be mixed have been selected, and a master designated, the frame-based energy is computed for each song using a conventional non-windowing energy computation 305. Next, as described below in Section 3.2.2, a scaled energy signal is computed for all scaled versions of the slave track for each alignment shift over a predetermined or user specified range of scales and alignment shifts 310. Further, in one embodiment, rather than computing the energy directly for every scaled version of the slave track, it is instead estimated for each time-scale via an energy signal approximation technique 315 which is described in further detail in Section 3.2.2.

Every computed energy signal for the slave track is then correlated against the single energy signal computed for the master track 320. The peak correlation value for each time-scale is then output to populate the set of correlation scores 330. Note that this set of correlation scores is also referred to herein as a "match curve." These correlation scores are then analyzed, and a group of one or more of the largest peaks are output 335 as corresponding to potentially optimal alignments and scalings for mixing the selected songs. However, in one embodiment, an alignment suitability metric or score is computed 345 for each of the peaks of the match curve. In particular, in this embodiment, the suitability of the scaling/alignment combination represented by each peak is evaluated to determine whether that combination is likely to result in a perceptually good mix to a human listener.

Next, given one or more correlation peaks, i.e., one or more potentially optimal alignments and scalings for mixing the selected songs, the next step is to select one of those correlation scores 340. The scaling and shifting parameters associated with that correlation score are then applied to the original slave track to compute a scaled and shifted version of the slave track 350.

In one embodiment, the relative energy of one or both of the songs is then scaled 355, i.e., it is made louder or softer so as to increase or decrease its contribution to the final mix, by either scaling the average energy of one song to be equivalent to the other song, or by increasing or decreasing the average energy of one or both songs so as to control the relative contribution of each song to the final mix.

Next, the scaled and shifted slave track is combined with the master track 360 using conventional techniques for combining audio signals. In other words, the scaled and shifted version of Song B and the original version of Song A are simply combined to create a composite or mixed version of the two songs. Finally, the mixed song is output 365 for real-time playback 270, or stored for later use 275, as desired.

3.2 Operational Details of the Music Mixer:

The following paragraphs detail specific operational embodiments of the music mixer described herein. In particular, the following paragraphs describe computation of frame-based energy signals from the input songs; energy signal correlation over all scales and shifts; selection of correlation sample window size; selection of the best alignment values; computing the time-scaled version of the slave track; and combining or mixing the signals to create a final mix.

3.2.1 Computing Frame-Based Energy:

As noted above, the frame-based energy, $E_a[k]$ and $E_b[k]$, is computed for Song A and Song B, respectively. Computing the frame-based energy of a signal such as Song A or Song B begins by first dividing that signal into a set of k frames represented by contiguous non-overlapping windows of N samples each. The energy of each frame $E_a[k]$ is then computed without multiplying the signal by a windowing function as illustrated by Equation 1:

$$E_a[k] = \left( \sum_{n=kN+1}^{kN+N} a[n]^2 \right)^{1/2} \qquad \text{Equation 1}$$

This type of computation for computing signal frame energy is well known to those skilled in the art.

Figure 4:
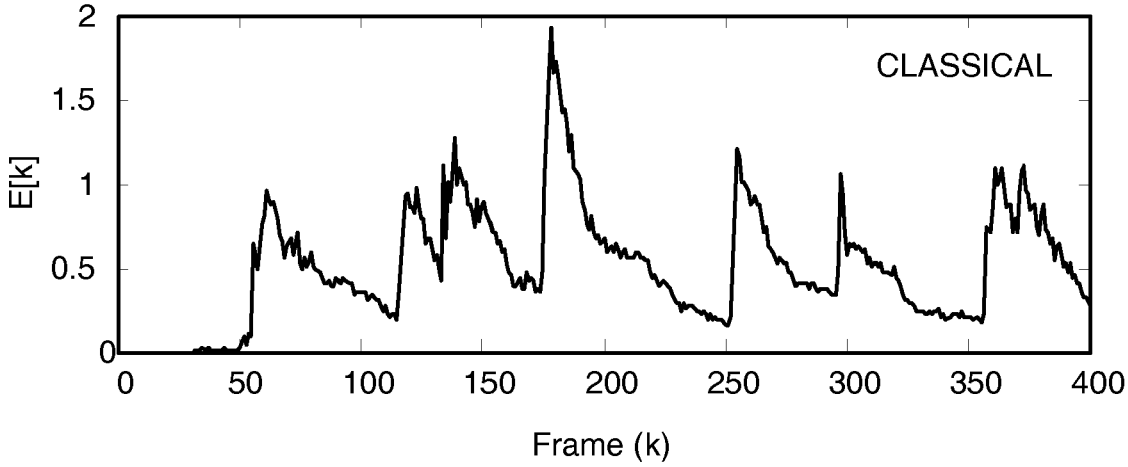
FIG. 4 illustrates a computed energy signal for a portion of a piece of classical music.
Figure 5:
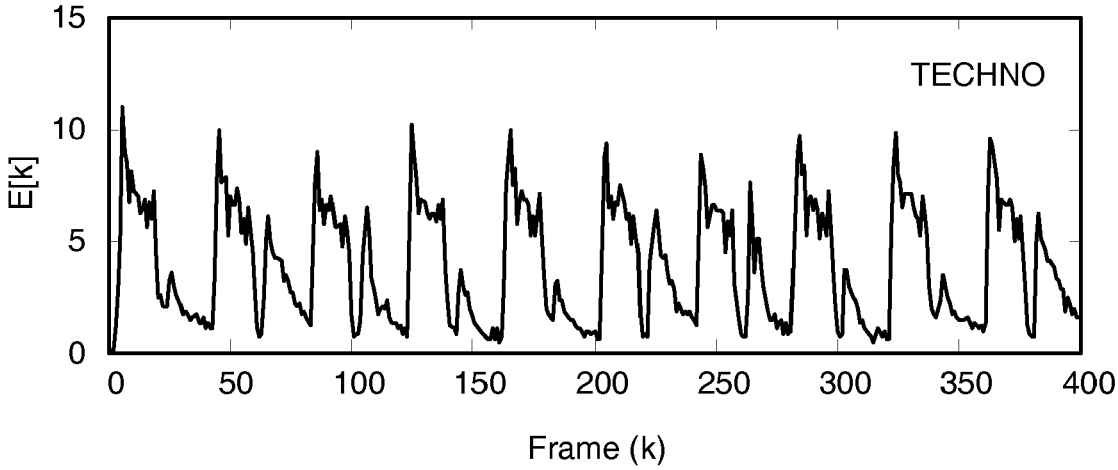
FIG. 5 illustrates a computed energy signal for a portion of a piece of Techno-type dance music.

Applying Equation 1 to a signal such as Song A results in the energy signal $E_a$. For example, FIG. 4 illustrates the computed energy signal for a portion of a piece of classical music, while FIG. 5 illustrates the computed energy signal for a portion of a piece of Techno-type dance music. Note that while there is a clear, repetitive energy structure in the dance piece of FIG. 5, there is little such information in the classical piece illustrated in FIG. 4. However, the two pieces are easily aligned using the energy-based mixing techniques described herein.

In a tested embodiment, the music mixer used a sampling rate of 44.1 kHz and a frame window size of 512 samples, corresponding to 12 ms, or about 86 frames per second. Clearly, other frame window sizes and sampling rates can be used, as desired. However, the numbers used in the tested embodiment were chosen because they correspond to conventional digital audio sampling rates and also because they serve to simplify time-scaling operations that are preformed on the computed energy signal, as described in the following sections.

3.2.2 Iterating Over Scales and Shifts:

Once the energy signals $E_a$ and $E_b$ have been computed, the next step (assuming that only Song B will be scaled and shifted), is to iterate the energy signal correlation over all scales and shifts of $E_b$ within some specified range. For example, using the illustration provided above with energy signal time-scalings of 0.5 to 2.0, and an iteration step size of 0.01, there are 150 time-scalings of $E_b$ that will be considered. Further, assuming a correlation range of only 100 samples (with each sample corresponding to a 12 millisecond energy value) and a correlation length of 1000 samples, the correlation will test a pair of 12 second regions over shifts of +/−0.6 seconds. This results in a total of 100*150 or 15,000 different scales and shifts of $E_b$ which must be compared to $E_a$ for the 1.2 second shift period represented by the 100 sample correlation range.

To allow for real-time mixing, these 15,000 comparisons must be computed very quickly. Ideally, the scaled version of Song B, i.e., signal b', would be computed for every scale step size, and then the energy signal $E_{b'}$ would be computed from the scaled signal. Unfortunately, this ideal computation is very computationally expensive, and can adversely affect real-time mixing capabilities of the music mixer, depending upon the computational power available for computations.

Therefore, to accomplish the resealing in real time, the energy of the time-scaled signal is approximated by time-scaling the original energy signal itself, rather than recomputing the energy signal for each time-scaled version of the input signal (i.e., Song B). This approximation is accomplished via a linear resampling of $E_b$ to produce $E_{b'}$. In particular, for each floating point scale factor s in the specified range (i.e., resampling $E_b$ at s times its current rate), the energy of the time-scaled signal at index n is approximated as illustrated by Equation 2, as follows:

$$f = sn - \text{floor}(sn)$$

$$E'_{b,s}[n] = (1-f)E[\text{floor}(sn)] + fE[\text{floor}(sn)+1] \quad \text{Equation 2}$$

Note that because the energy signal was not windowed during computation of the frame energy, the time-scaled version of the energy signal ($E'_b$) closely approximates the energy of the time-scaled signal ($E_{b'}$). This convenient property is demonstrated by the following discussion.

For example, consider that signal b was to be slowed down by a factor of exactly two via linear interpolation to form b' (i.e., s=0.5). The precise values for b' and for the ideal energy of the time-scaled signal can then be expressed as illustrated by Equation 3, as follows:

$$b'[2n] = b[n]$$

$$b'[2n-1] = \frac{b[n] + b[n-1]}{2}$$

$$E_{b'}[2k] = \left(\sum_{n=2kN+1}^{2kN+N} b'[n]^2\right)^{1/2} = \left(\sum_{n=kN+1}^{kN+N/2} b'[2n]^2 + \sum_{n=kN+1}^{kN+N/2} b'[2n-1]^2\right)^{1/2}$$

$$E_{b'}[2k] = \left(\sum_{n=kN+1}^{kN+N/2} b[n]^2 + \sum_{n=kN+1}^{kN+N/2} \left(\frac{b[n] + b[n-1]}{2}\right)^2\right)^{1/2}$$

$$E_{b'}[2k] = \left(\sum_{n=kN+1}^{kN+N/2} b[n]^2 + \frac{1}{4}\sum_{n=kN+1}^{kN+N/2} b[n]^2 + \frac{1}{4}\sum_{n=kN+1}^{kN+N/2} b[n-1]^2 + \frac{1}{2}\sum_{n=kN+1}^{kN+N/2} b[n]b[n-1]\right)^2 \quad \text{Equation 3}$$

If the signal is not varying too quickly, and the song, b[n]≈b[n+1], then as illustrated by Equation 4, it can be seen that $$E_{b'}[2k] \approx \left(2\sum_{n=kN+1}^{kN+N/2} b[n]^2\right)^{1/2} \quad \text{Equation 4}$$

$$E_{b'}[2k+1] \approx \left(2\sum_{n=kN+N/2+1}^{kN+N} b[n]^2\right)^{1/2}$$

$$(E_{b'}^2[2k] + E_{b'}^2[2k+1])^{1/2} \approx \left(2\sum_{n=kN+1}^{kN+N} b[n]^2\right)^{1/2} = \sqrt{2}\,E_b[k]$$

In other words, the energy of a superframe composed from the corresponding frames of $E_{b'}[2k]$ and $E_{b'}[2k+1]$ has the same energy as frame k in $E_b$, modulo a scale factor of $\sqrt{2}$, since there is now twice as long a frame to contend with. If the same frame size is then used in the stretched signal, and the energy is not changing rapidly from frame to frame, i.e., $E_{b'}[2k] \approx E_{b'}[2k+1]$, it can be seen that the energy of the time-scaled signal is approximately equal to the energy of the corresponding location in the original signal, as illustrated by Equation 5:

$$E_{b'}[2k] \approx E_{b'}[2k+1] \quad \text{Equation 5}$$

$$\Leftrightarrow \left(2\sum_{n=kN+1}^{kN+N/2} b[n]^2\right)^{1/2} \approx \left(2\sum_{n=kN+N/2+1}^{kN+N} b[n]^2\right)^{1/2}$$

$$\Leftrightarrow \sum_{n=kN+1}^{kN+N/2} b[n]^2 \approx \sum_{n=kN+N/2+1}^{kN+N} b[n]^2$$

$$\Leftrightarrow \sum_{n=kN+1}^{kN+N} b[n]^2 \approx 2\sum_{n=kN+1}^{kN+N/2} b[n]^2$$

-continued $$\Leftrightarrow \left(\sum_{n=kN+1}^{kN+N} b[n]^2\right)^{1/2} \approx \left(2\sum_{n=kN+1}^{kN+N/2} b[n]^2\right)^{1/2}$$

$$\Leftrightarrow E_b[k] \approx E_{b'}[2k]$$

Therefore, it is reasonable to approximate the energy of the time-scaled signal ($E_{b'}$) by the time-scaled energy signal ($E'_b$). However, it should be noted that while the resulting signals are very similar, there are differences between them. In particular, the approximation, $E'_b$, of the time-scaled energy signal tends to be a somewhat smoothed version of the actual signal $E_{b'}$. This smoothing effect tends to increase as the amount of scaling increases. For example, while a relatively large time-scaling of s=0.5 will result in noticeable smoothing in the approximation signal $E'_b$, a smaller time scaling (i.e., a scaling closer to 1), such as s=0.9, will result in an approximation signal $E'_b$ that is nearly identical to the actual signal $E_{b'}$.

However, even with the observed smoothing effects at larger time-scaling factors, the peaks of the approximated time-stretched energy signal $E_{b'}$ are close enough to those of the actual signal $E_{b'}$ that their use in place of the actual signal will not significantly degrade the performance of the music mixer. Further, using the approximation signal $E_{b'}$ allows for a significant reduction in computational overhead, thereby allowing for faster than real-time mixing operations on a typical PC-type computer.

Given the computed energy signal for Song A, $E_a$ and the computed or approximated time-scaled versions of the energy signal for Song B, $E_{b'}$ or $E'_b$, respectively, the next step is to compute an alignment or correlation score for the scaled energy signal for all possible shifts in the range specified against $E_a$. This alignment score is obtained by computing a normalized correlation between the entirety of $E_a$ against the entirety of $E_{b'}$ (or $E'_b$ if an approximation of the scaled energy signal is used) for each integer shift in the range of correlations specified (100 samples in the above-illustrated example, −50 to 50).

In particular, for each scaling value s for $E_b$, and for each correlation k, the inner product is computed as illustrated by Equation 6, as follows:

$$C_s[k] = \frac{\sum_{i=1}^{N} E_a[i]E'_{b,s}[i+k]}{\left(\sum_{i=1}^{N} E_a[i]^2\right)^{1/2}\left(\sum_{i=1}^{N} E'_{b,s}[i+k]^2\right)^{1/2}} \quad \text{Equation 6}$$

The maximum score is then chosen to represent the overall score for each timescale, i.e., $$C[s] = \max_k C_s[k].$$

3.2.3 Selection of Correlation Length:

The correlation length, N, is a critical choice, and represents the length of the segments of the songs over which matching will be done. In the example provided above, a correlation length of 1000 sample frames was discussed. It should be noted that using larger numbers of sample frames may degrade performance where the tempos of the component songs (i.e., Song A and Song B) are changing rapidly.

Figure 6:
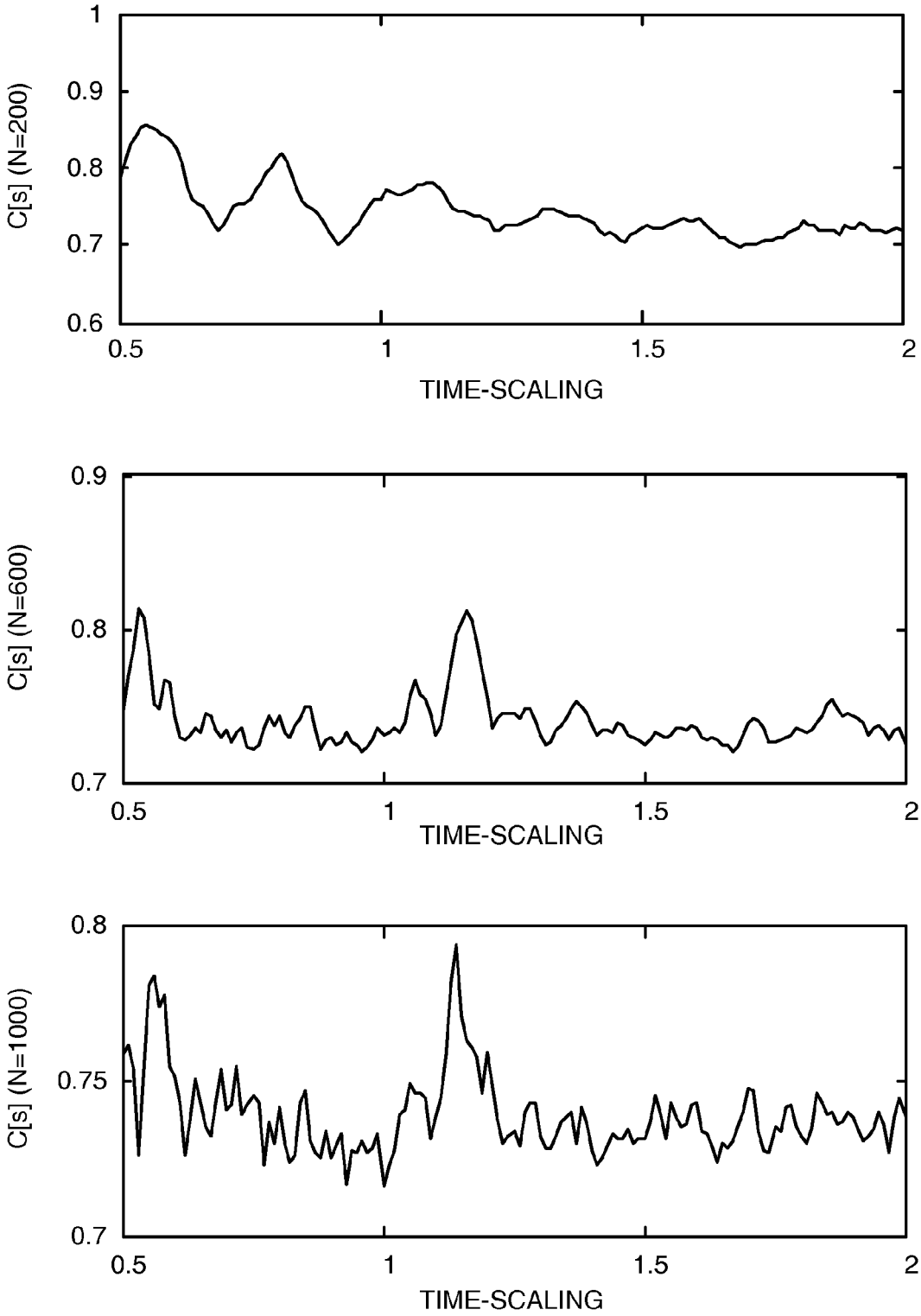
FIG. 6 illustrates three plots of "correlation score" vs. time-scaling, showing a sharpening of correlation peaks as the number of samples used in a correlation window increases.
Figure 7:
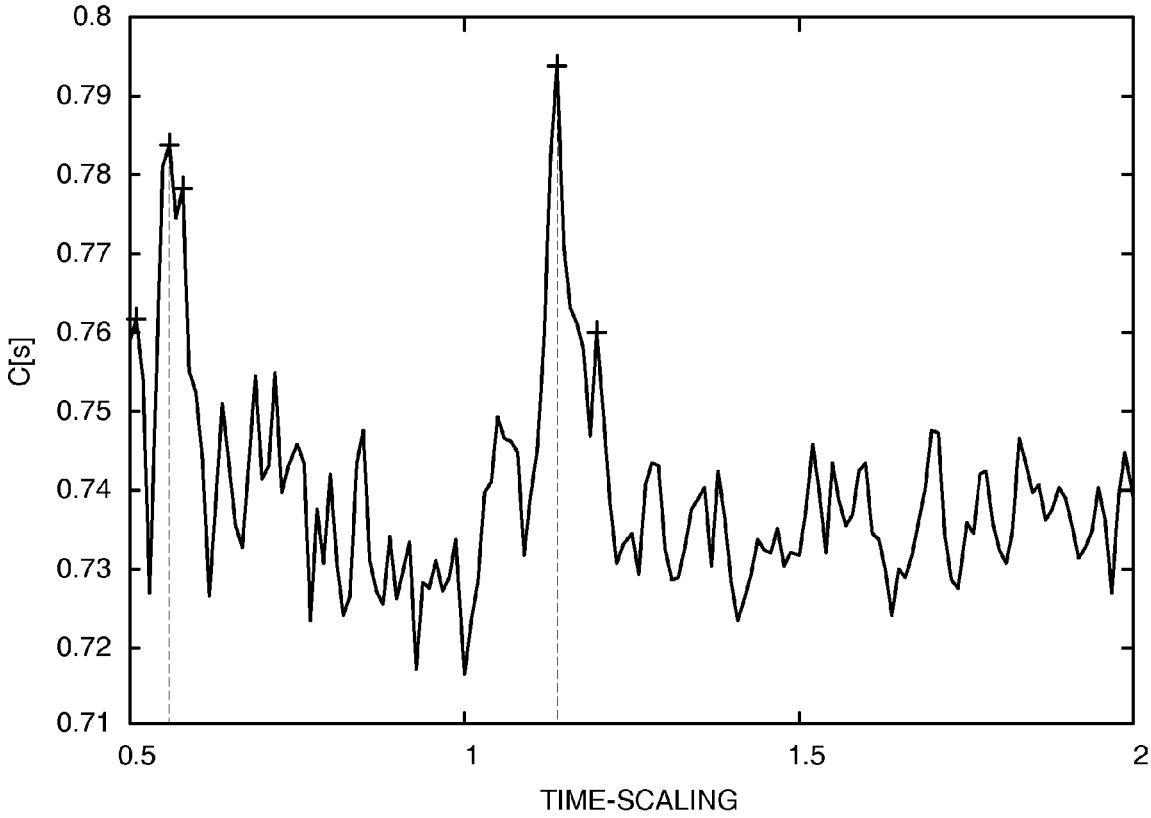
FIG. 7 provides a correlation score "match curve" for the energy signals illustrated in FIG. 4 and FIG. 5.

For example, in the case where Song A is not heavily beated, and Song B is more heavily beated, using a longer window (larger number of sample frames) allows for a higher confidence in finding a scaling of Song B against which it is best aligned. The effect is illustrated by FIG. 6 which shows the sharpening of the correlation peaks as N ranges from 200 to 1000. Note that with a short window of only 200 frames, there are no clear peaks, and in fact the strongest peak of the set is not yet visible. However, as N increases, the peaks at about 0.6 and 1.2 become increasingly pronounced for the particular songs that were used to create the energy signals which were used in computing the correlations illustrated by FIG. 7. The peaks at about 0.6 and 1.2 illustrated in FIG. 7 then represent the scalings that are the best matches for the particular pair of signals used.

3.2.4 Selection of the Best Alignment:

Following the correlation step described above, a set of possible alignments indexed by s along with the corresponding scores is available, i.e., the set C[s], as described above, has been populated using the computational techniques described above. Given this set of possible alignments, for each scaling s, peak locations are then identified in the set by choosing all points that are greater than both their left and right neighbor. While this is a relatively simplistic measure, it guarantees that all possible peaks are identified while avoiding any redundancy resulting from just choosing the top n values. Clearly, simply choosing the top n values from this set would typically just return the nearest neighbors of the highest peak, rather than actually identifying unique peaks. Once these peaks have been identified, the peaks having the top n scores, where n represents some desired number of possible alignments, over all scalings k are selected as the n best possible alignments from the set C[s].

In one embodiment, all of these top n alignment/scaling pairs are then presented to a user for manual selection in mixing Song A and Song B. In another embodiment, one of these top n alignment/scaling pairs is simply selected automatically for use in mixing the two songs.

It should be noted that while the processes described above provide a strong mathematical match between two songs, this strong match will not always produce a mix which is pleasing to a human listener. Consequently, in another embodiment, described in detail below in Section 3.3, a "suitability metric" is automatically computed and evaluating whether a particular alignment/scaling pair will produce a mix which is likely to sound good to a human listener. In other words, the suitability metric is useful for determining whether a potential mix of the two songs is a "strong mix" or a "weak mix."

3.2.5 Computing the Time-Scaled Final Signal:

Once the candidate scalings/shifts have been determined as described above, the signal b needs to scaled and shifted in the same way that $E'_b$ was scaled and shifted, so as to produce signal b' (i.e., the scaled and shifted version of Song B). There are a variety of well known techniques for scaling the length of audio signals such as a song, any of which may be used by the music mixer. A number of such techniques involve some time of linear resampling of the signal. Other such techniques involve the use of pitch-preserving time-scaling algorithms such as the well known SOLA (synchronized overlap-and-add) technique. One advantage of using simple linear resampling of the signal is that such techniques are inexpensive to compute since they are generally equivalent to playing the sound faster or slower. This results in both length and pitch changes but also provides a greater preservation of signal quality. On the other hand, using pitch preserving techniques such as SOLA serves to maintain the pitch of a song while changing only the length. Again, any conventional technique for scaling of audio signals may be used by the music mixer described herein.

3.2.5 Combining/Mixing the Signals:

In one embodiment, the signals a and b' (i.e., Song A and scaled/shifted version of Song B, respectively) are simply summed together to produce a composite or mixed song. However, as noted above, either Song A, or Song B can be scaled in terms of average energy so as to reduce or increase the overall contribution of either song to the final mix.

For example, in one embodiment, to ensure an equal contribution of each song to the mix, a scaling factor r is applied to one of the signals for scaling the average energy of that signal so that it is equal to the average energy of the other signal. The combined signal will then exhibit an equal contribution from each song. In other words, assuming that the scaled Song B, i.e., b', will be further scaled in terms of its average energy, the scaling factor r is chosen in a way to make the average energy of a and b' equal. The effect here is similar to equalizing the volume of each song so that one song does not overwhelm the other song in the mix. This scaling factor for b' can be automatically determined as illustrated by Equation 7, as illustrated below:

$$r = \frac{\sum E_a[k]}{\sum E'_b[k]} \quad \text{Equation 7}$$

This auto-scaling has been observed to be quite effective for most mix samples. However, in order to provide for greater user control over the final mix, in one embodiment, the user is provided with the capability to manually increase or decrease the average energy of either song (similar to turning the volume up or down for one of the songs). This capability for manual adjustment of the signal energy allows the user to achieve greater control over the aesthetics of the final mix of the two signals.

Note that this capability is very useful for a typical DJ'ing situation, where it is common for a user to modify this energy scaling parameter dynamically, bringing the mixed-in sound in and out based on the musical context. Similarly, given this capability, the user is provided with a real-time energy/volume scaling ability so that one song can be manually cross-faded with another song (in terms of volume) while any overlapping portion of the two songs is mixed using the techniques described above to provide an apparent continuity between the songs. Further, in another related embodiment, in the case where a second song is being faded in to the end of a first song, and the overlapping portion of that second song is scaled for the mix, as described above, then the scaling of that song can then be gradually returned to normal (i.e, a scaling of 1.0), or any other desired speed, following the end of the overlapping portion of the two songs so as to prevent sudden speed changes in the song which might be jarring or otherwise unpleasant to a human listener.

3.3 Computing a Mixing Suitability Metric:

As noted above, not all strong mathematical correlations necessarily result in an aesthetically pleasing mix of two songs. Consequently, in some cases it may be useful to evaluate how good a particular mix is likely to be before that mix is presented to the user. Therefore, in one embodiment, an automatic evaluation of how good each match is likely to be is performed by evaluating the relative shape of the correlation value C[s] of each potential match respect to the peaks representing the other potential matches. This automatic evaluation takes the form of a "suitability metric" as described below.

In particular, as noted above, it has been observed that in the case where there are a large number of scattered correlation peaks of around the same value, then none of the possible alignments of Song A and Song B tends to sound particularly good when heard by a human listener. Conversely, where there are only a few very clear, isolated peaks, the matches represented by each of those peaks tend to correspond to shift/scaling alignments of Song A and Song B that do sound particularly good when heard by a human listener.

Therefore, in one embodiment, both the shape, value, and local environment of each peak (relative to the surrounding correlation peaks and values) are examined in computing a suitability metric for attempting to identify those correlation peaks which correspond to alignments that are more likely to sound good to a human listener. Using this suitability metric, in some cases, a particular correlation peak having a lower magnitude than other peaks might still exhibit a higher suitability, depending upon its shape, and its relationship to any surrounding peaks. Possible alignments are then presented to the user in order of suitability score, from highest to lowest.

In particular, if the correlation scores, C[s], are plotted against the scaling factor, s, then it is typically easy to visually observe there is a set of one or more peaks which particularly stand out from other peaks in the plot. Alignment values corresponding to peaks can then be selected for mixing the songs. However, presenting such plots to a user is not typically a user friendly method for presenting such data to most users. Therefore, in one embodiment the suitability of the potential match represented by each peak is characterized by evaluating the characteristics of each peak relative to any neighboring correlation score peaks. This evaluation is then presented as a numerical suitability score to the user to allow for selection based on likely suitability rather than on raw correlation scores.

To compute the correlation score suitability metrics, the value of each peak is first normalized by the mean and variance of the match curve (i.e., the set correlation scores, C[s]), with the area corresponding to the peak of interest having first been removed from that match curve. To remove the peak context (i.e., the area of the peak), that peak is bracketed by the valleys to the immediate left and right of the peak of interest, where valleys are defined in a similar manner to the way that peaks are defined, i.e., points that are lower than both their left and right neighbors. Note that the reason for removing the area corresponding to the peak of interest when determining the mean and variance of the match curve is to prevent the values from the peak itself from affecting the variance.

Therefore, for a particular peak location at s*, the peak suitability metric, p, is computed as illustrated by Equation 8, as follows:

$$p[s^*] = \frac{C[s] - \overline{C}}{\sum_{s/context(s^*)} (C[s] - \overline{C})^2} \quad \text{Equation 8}$$

where $\overline{C}$ is the mean of C[S], again excluding the context of the peak, k*, being evaluated for suitability In general, It has been observed that peaks with suitability values greater than 3.0 tended to result in good matches, while the rest were of variable quality in terms of aesthetic appeal to a human listener.

In view of the discussion provided above, it should be clear that selection of the best peak from the set of the correlation scores, C[s], depends both on the suitability and on the value of those correlation scores. If the suitability is low, it may be better not to mix at all, even with a strong match represented by a high correlation. However, there are usually several choices to pick from, even where the suitability score is relatively low. Generally, the highest peak will tend to produce the best mix, but if the method is being applied in a DJ'ing context, it is often better to choose a peak with a value of s close to 1.0, so as to require minimal distortion and/or stretching of either of the songs being used to create the mix.

3.4 Additional Considerations and Embodiments:

As noted above, the music mixer is capable of automatically determining one or more potentially optimal mixes of two or more songs without the need to ever evaluate the actual beat structure of any of those songs. However, in some situations, it is possible to further enhance the mixing capabilities of the music mixer by also considering the beat structure of the songs in addition to identifying the possible mixes via the energy signal evaluations described above.

In particular, the energy signal-based evaluations described above generally attempt to find the best alignment of the energies of the two songs given all scalings and shiftings of at least one of the songs. However, since there is no attempt to examine the time signature inherent in the songs, there are situations in which differing time scales (i.e., ¾ vs. ⁴⁄₄ time) will result in mathematically acceptable mixes which will sound terrible to a human listener. For example, in some cases, fitting three beats of one song to a quarter note of another song is mathematically almost as good as fitting four beats to the quarter note. Unfortunately this tends to produce a perceptually unacceptable mix.

Consequently, in one embodiment, after determining possible mixes via the energy signal evaluations described above, the beat of each song is determined using conventional methods for examining the beat structure of music. Then, the possible mixes based on the peaks from the set of correlation scores, C[s], are further evaluated to ensure that each of those peaks will result in compatible time scalings between the songs. Any of the correlation scores, C[s], that would effectively mix aesthetically incompatible time scales (such as a direct mix of ¾ time music and ⁴⁄₄ time music) will either be flagged or otherwise identified as resulting in incompatible time scales. In an alternate embodiment, the suitability metric for such correlation scores will be reduced so as to alert the user to potentially bad time-scale mixes.

The foregoing description of the music mixer has been presented for the purposes of illustration and description. It is not intended to be exhaustive or to limit the invention to the precise form disclosed. Many modifications and variations are possible in light of the above teaching. Further, it should be noted that any or all of the aforementioned alternate embodiments may be used in any combination desired to form additional hybrid embodiments of the music mixer. It is intended that the scope of the invention be limited not by this detailed description, but rather by the claims appended hereto.

What is claimed is:

1. A computer-readable medium having computer executable instructions for automatically mixing two songs, said computer executable instructions comprising steps for:

computing a frame-based energy signal for a first song;

for each of a set of time-scalings computing a frame-based energy signal for at least one second song for each of a set of time-shifts;

comparing each of the computed frame-based energy signals of each second song to the frame-based energy signal of the first song;

measuring an alignment between each of the compared energy signals;

selecting one of the second songs and a recommended time-shift and time scaling pair for the first song and the selected second song based on an analysis of the measured alignments;

applying the selected time-shift and time scaling pair to scale and shift the selected second song; and combining the first song with the scaled and shifted second song.

2. The computer-readable medium of claim 1 wherein the step for computing each frame-based energy signal for the second song comprises steps for approximating at least one of those frame-based energy signals.

3. The computer-readable medium of claim 1 further comprising steps for equalizing an average energy of the first song and the scaled and shifted second song prior to combining each song.

4. The computer-readable medium of claim 1 further comprising steps for manually adjusting an average energy of at least one of the first song and the scaled and shifted second song prior to combining each song so as to control a relative contribution of each song to the combination of the two songs.

5. The computer-readable medium of claim 1 further comprising steps for providing a user selectable set of two or more recommended time-shift and time scaling pairs based on the analysis of the measured alignments.

6. The computer-readable medium of claim 5 further comprising steps for providing a set of user selectable audio previews of the combination of the first song and the scaled and shifted second song, each audio preview corresponding to one of the recommended time-shift and time scaling pairs.

7. The computer-readable medium of claim 5 further comprising steps for computing a suitability score for each pair in the set of recommended time-shift and time scaling pairs.

8. The computer-readable medium of claim 7 wherein the step for computing the suitability scores further comprises steps for determining the suitability scores by analyzing the measured alignments corresponding to each pair in the set of recommended time-shift and time scaling pairs.

9. The computer-readable medium of claim 7 wherein the step for selecting the second song comprises steps for selecting the second song having a time-shift and time scaling pair with a highest suitability score.

10. A method for mixing music segments of arbitrary genre, comprising:

selecting at least two segments of music to be mixed;

designating at least one of the segments as a master track, and at least one of the segments as a slave track;

computing a frame-based energy signal for the at least one master track over a predefined period;

providing a pre-defined range of time-scaling values and a scale step size for iteratively moving from the lowest value to the highest value of the pre-defined range of time-scaling values;

providing a range of alignment shift values, said range of shift values being equal to a predefined correlation sample size;

for every time-scaling value between the lowest value and the highest value of the pre-defined range of time-scaling values, inclusive, computing a separate frame-based energy signal for the at least one slave track for every alignment in the range of alignment shift values;

determining a correlation value between every computed frame-based energy signal for the at least one slave track and the computed frame-based energy signal for the at least one master track;

identifying a maximum correlation value for each alignment shift in the range of alignment shifts, and identifying those maximum correlation values as defining a match curve over the pre-defined range of time-scaling values;

identifying at least one peak in the match curve as representing a set of potentially optimal mix settings;

selecting one of the potentially optimal mix settings and applying those mix settings to scale and shift the slave track; and mixing the scaled and shifted slave track with the master track to create a mixed track.

11. The method of claim 10 wherein computing each separate frame-based energy signal for the at least one slave track comprises approximating each of the frame-based energy signals.

12. The method of claim 10 further comprising computing a suitability metric for evaluating a mixing suitability for each set of potentially optimal mix settings.

13. The method of claim 10 further comprising equalizing an average energy of each of the master track and the scaled and shifted slave track prior to mixing those tracks.

14. The method of claim 10 further comprising manually adjusting an average energy of at least one of the master track and the scaled and shifted slave track prior to mixing those tracks.

15. The method of claim 10 further comprising providing a set of user selectable audio previews, wherein selection of each audio preview provides a playback of a mixed track corresponding to one of the potentially optimal mix settings.

16. A computer-readable medium having computer executable instructions for automatically transition ing from one music track to another music track, said computer executable instructions comprising program modules for:

computing a frame-based energy signal for at least a portion of a master music track;

for each of a set of time-scalings computing a frame-based energy signal for each of at least a portion of a one or more slave music tracks for each of a set of time-shifts;

comparing each of the computed frame-based energy signals of the slave music tracks to the frame-based energy signal of the master music track;

measuring an alignment between each of the compared energy signals;

selecting at least one time-shift and time scaling pair and an associated one of the slave music tracks based on an analysis of the measured alignments;

applying the selected time-shift and time scaling pair to scale and shift to at least a portion of the selected slave music track to align the selected slave music track to the master music track; and over a predetermined overlap period, automatically fading in the scaled and shifted slave music track while simultaneously fading out the master music track to effect an energy aligned transition between the master music track and the selected slave music track.

17. The computer-readable medium of claim 16 wherein the program module for applying the selected time-shift and time scaling pair to scale and shift to at least a portion of the selected slave music track further comprises a program module for decreasing the time scaling of the selected slave track to a predetermined level, with the decrease beginning at the end of the predetermined overlap period.

18. The computer-readable medium of claim 17 wherein the predetermined level is zero time scaling.

19. The computer-readable medium of claim 16 further comprising a program module for computing a suitability score for each time-shift and time scaling pairs.

20. The computer-readable medium of claim 19 wherein the program module for selecting at least one time-shift and time scaling pair and an associated one of the slave music tracks further comprises a program module for selecting the time-shift and time scaling pair and the associated slave music track having a highest suitability score.

* * * * *